US005357071A

United States Patent [19]

Hanaki

[11] Patent Number: 5,357,071

[45] Date of Patent: Oct. 18, 1994

[54] SWITCH DEVICE HAVING STRUCTURE FOR MINIMIZING VIBRATION OF AN OPERATING KNOB

[75] Inventor: Akira Hanaki, Aichi, Japan

[73] Assignee: Kabushiki Kaisha Tokai Rika Denki Seisakusho, Aichi, Japan

[21] Appl. No.: 31,727

[22] Filed: Mar. 15, 1993

[30] Foreign Application Priority Data

Mar. 24, 1992 [JP] Japan ..... 4-015328[U]

[51] Int. Cl.[5] ..... H01H 21/24

[52] U.S. Cl. ..... 200/557; 200/339

[58] Field of Search ..... 200/339, 557, 561, 437

[56] References Cited

U.S. PATENT DOCUMENTS

| | | | |
|---|---|---|---|
| 2,832,852 | 4/1958 | Andrew | 200/437 |
| 4,314,111 | 2/1982 | Kobayashi | 200/339 |
| 4,814,554 | 3/1989 | Magiera | 200/437 |

FOREIGN PATENT DOCUMENTS

| | | | |
|---|---|---|---|
| 173526 | 7/1989 | Japan | 200/339 |
| 242542 | 9/1990 | Japan | 200/339 |

*Primary Examiner*—Renee S. Luebke

*Attorney, Agent, or Firm*—Finnegan, Henderson, Farabow, Garrett & Dunner

[57] ABSTRACT

A switch device has an operating knob held at a neutral position by a slider. The operating knob includes an articular recess swingably provided over a base body. A spring and the slider are set in a rectangular pipe which is a part of the base body. Guide pins at the outer end portion of the slider are loosely engaged with slide grooves formed in guide-pin guiding portions. When the slider, being urged by the spring, is in engagement with the articular recess, it holds the operating knob at the neutral position so that the operating knob is allowed to swing about the guide pins.

5 Claims, 1 Drawing Sheet

SWITCH DEVICE HAVING STRUCTURE FOR MINIMIZING VIBRATION OF AN OPERATING KNOB

BACKGROUND OF THE INVENTION

This invention relates to a switch device which is so designed that its operating knob is held at the neutral position with a slider.

The arrangement of a conventional switch device of this type will be described with reference to FIGS. 3 and 4.

As shown in FIG. 3, an operating knob 3 with an articular recess 2 is mounted over a base body 1 in such a manner that it is swingable about a shaft 1*a*. The base body 1 has a cylindrical portion 1*b*, in which a compression spring 4 is accommodated. A slider 5 is mounted on the top of the compression spring 4. More specifically, the slider 5 is set as follows: The base end portion of the slider 5 is fitted in the cylindrical portion 1*b* of the base body 1 with a suitable clearance therebetween, and the upper end portion is engaged with the articular recess 2. The slider 5 is urged by the compression spring 4 to hold the operating knob 3 at the neutral position as shown in FIG. 3.

When the operating knob 3 is swung, the slider 5 is pushed by the sloped surface 2*a* of the articular recess 2, so that the slider 5 is moved downwardly along the inner surface of the cylindrical portion 1*b* while the outer cylindrical surface of the base end portion of the slider 5 is being guided by the inner cylindrical surface of the cylindrical portion 1*b*. As a result, an operating piece 6 is depressed by a depressing piece 3*a* of the operating knob 3, so that contact means (not shown) is turned on.

In the above-described switch device, the base end portion of the slider 5 is loosely fitted in the cylindrical portion 1*a* of the base body. Therefore, when the slider 5 is vibrated about its base end portion as shown in FIG. 4, the operating knob 3 engaged with the upper end portion of the slider 5 is greatly vibrated.

If the operating knob 3 is greatly vibrated in the above-described manner, then the vibration impedes its smooth operation. Moreover, in the case where the switch device is employed as a power window regulator switch in an automobile, it will produce abnormal noises as the automobile travels.

SUMMARY OF THE INVENTION

In view of the foregoing, an object of this invention is to provide a switch device with its operating knob held at the neutral position by a slider, in which the vibration of the operating knob is minimized.

The foregoing object of the invention has been achieved by the provision of a switch device comprising: a base body; an operating knob which is swingably provided over the base body and has an articular recess made up of opposed sloped surfaces; and a slider which is slidably provided on the base body, and energized to engage with the articular recess, to hold the operating knob at the neutral position, the slider being slid while being pushed by the sloped surface of the articular recess when the operating knob is swung, in which, according to the invention, the slider has guide pins protruded from the end portion thereof, and the base body has guide-pin guiding portions with slide grooves which guide the guide pins when the slider is slid.

In the switch device of the invention, the slider is vibrated about the guide pins provided at its end portion. Therefore, the amount of vibration of the slider is smaller than in the conventional switch device in which the slider vibrates about its base end.

DETAILED DESCRIPTION OF THE PREFERRED EMBODIMENT

Figure 2:
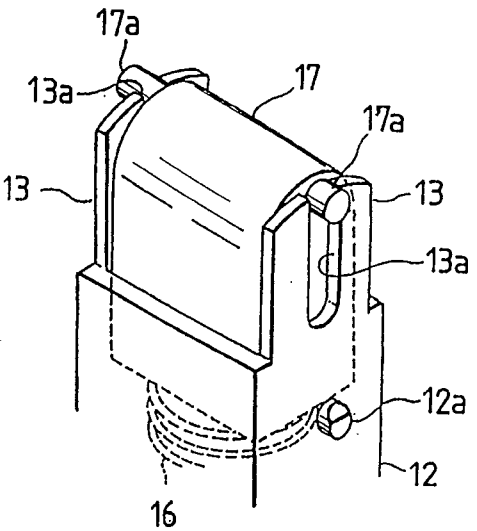
FIG. 2 is a perspective view showing essential components of the switch device.

A switch device according to this invention, which is applied to a power window regulator in an automobile, will be described with reference to FIGS. 1 and 2.

A pipe 12, rectangular in section, (hereinafter referred to as "a rectangular pipe 12", when applicable) is extended upwardly from a base body 11. Two opposed walls of the rectangular pipe 12 are extended upwardly, and formed into guide-pin guiding portions 13 and 13 which are each in the form 10 of a plate. The guide-pin guiding portions 13 have slot-shaped slide grooves 13*a* and 13*a*, respectively, which are extended vertically. Two engaging protrusions 12*a* and 12*a* (only one shown) are formed on the outer surfaces of the two opposed walls of the rectangular pipe 12, respectively.

The base body 11 is provided with operating-piece accommodating protrusions 14 and 15 on both sides of the rectangular tube 12. Operating pieces 14*a* and 15*a* are provided in the operating-piece accommodating protrusions 14 and 15, respectively, in such a manner that they are vertically movable. For instance, when the operating piece 14*a* is moved downwardly, first contact means (not shown) is turned on to output a "DOWN" signal to move the window glass downwardly; and when the operating piece 15*a* is moved downwardly, second contact means is turned on to output an "UP" signal to move the window glass upwardly.

A coiled compression spring 16 is accommodated in the rectangular pipe 12. A slider 17 is placed on the top of the spring 16, so that the slider 17 is moved up and down with expansion and contraction of the spring 16. More specifically, the base end portion of the slider 17 is fitted in the rectangular pipe 12 in such a manner that it is located between the guide-pin guiding portions 13 and 13.

Guide pins 17*a* and 17*a* are protruded from the upper end portion of the slider 17, and they are loosely engaged with the slide grooves 13*a* and 13*a* of the guide-pin guiding portions 13 and 13, respectively. When the slider 17 is moved vertically, the guide pins 17*a* and 17*a* are guided by the slide grooves 13*a* and 13*a*; that is, the guide pins 17*a*, being guided by the slide grooves, cause the slider 17 to move vertically along the slide grooves 13*a* and 13*a*.

The switch device has an operating knob 18, which has engaging holes (not shown) in correspondence to the above-described engaging protrusions 12*a* and 12*a*. With the engaging holes engaged with the engaging protrusions 12*a*, the operating knob 18 is swingably mounted on the base body 11.

The operating knob 18 has an articular recess 19 which is made up of two opposed sloped surfaces 19*a* and 19*b*. The upper end of the slider 17 is engaged with the articular recess 19; that is, it is abutted against the latter 19. Normally, the engagement is maintained by the elastic force of the spring 16, so that the operating knob 18 is held at the neutral position as shown in FIG. 1. When, under this condition, the operating knob 18 is swung about the engaging protrusions 12*a*, the upper end of the slider 17 is pushed by the sloped surface 19*a* or 19*b* of the articular recess 19, so that the slider 17 is slid downwardly against the elastic force of the spring 16.

Elongated depressing portions 18*a* and 18*b* are protruded from the inner surface of the operating knob 18. When the operating knob 18 is swung in the direction of the arrow A, the depressing portion 18*a* depresses the operating piece 14*a*; and when the operating knob 18 is swung in the direction opposite to the direction of the arrow A, the depressing portion 18*b* depresses the operating piece 15*a*.

The operation of the switch device thus constructed will be described.

Figure 1:
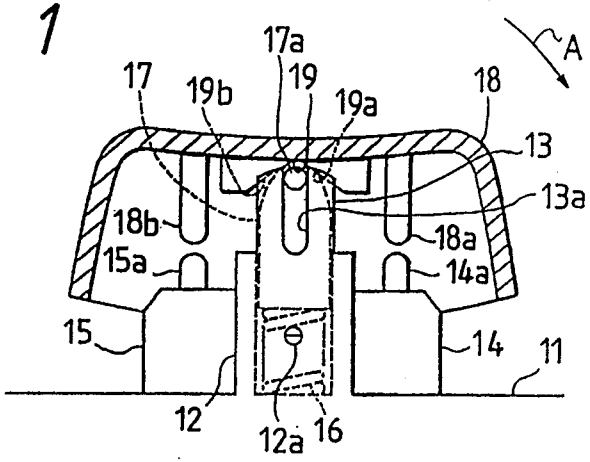
FIG. 1 PRIOR ART
FIG. 1 is a front view, with parts sectioned, of a switch device, which constitutes one embodiment of this invention.
Figure 4:
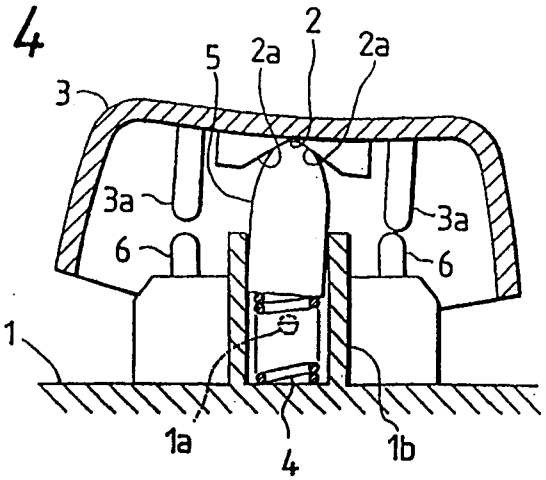
FIG. 4 PRIOR ART
FIG. 4 is also a vertical sectional view showing a state of the conventional switch device with its operating knob vibrated.
Figure 3:
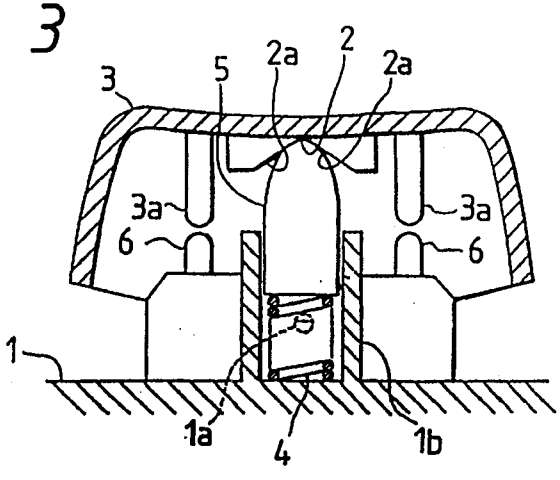
FIG. 3 is a vertical sectional view of a conventional switch device.

When, with the operating knob 18 set at the neutral position as shown in FIG. 1, the operator pushes the top right part of the operating knob 18 with the finger; that is, the operating knob 18 is swung in the direction of the arrow A, the upper end of the slider 17 is depressed by the sloped surface 19*b* of the articular recess 19. As a result, the guide pins 17*a* and 17*a* of the slider 17 being guided by the slide grooves 13*a* and 13*a*, the slider 17 is moved downwardly along the slide grooves 13*a* and 13*a* against the elastic force of the spring 16.

At the same time, the operating piece 14*a* is moved downwardly being depressed by the depressing portion 18*a*, so that the first contact means is turned on to output the "DOWN" signal to move the window glass downwardly.

Thereafter, when the operating knob 18 is released, the slider 17 is moved upwardly by the elastic force of the spring 16, thus pushing the operating knob 18 upwardly along the sloped surface 19*a* of the articular recess 19. As a result, the operating knob 18 is swung in the direction opposite to the direction of the arrow A, so that the slider 17 is engaged with the articular recess 19, thus being set at the neutral position automatically.

When the operating knob 18 is turned in the direction of the arrow A, the switch device operates as described above. In the case where the operating knob 18 is turned in the direction opposite to the direction of the arrow A, similarly the operating piece 15*a* is moved downwardly by the depressing portion 18*b* of the operating knob 18, so that the second contact means (not shown) is turned on to output the "UP" signal to move the window glass upwardly.

The switch device thus designed has the following effects or merits:

In the switch device, the guide pins 17*a* and 17*a* are formed on the end portion of the slider 17, and engaged with the slide grooves 13*a* and 13*a*, respectively. Hence, the slider 17 is allowed to vibrate about the guide pins 17*a* and 17*a* formed on its end portion.

Therefore, the amount of vibration of the operating knob 18 engaged with the upper end portion of the slider 17 is small when compared with that in the conventional switch device in which the slider is vibrated about its base end. Hence, the operating knob 18 can be operated more smoothly, and the difficulty is eliminated that the switch knob produces abnormal sounds being vibrated during traveling of the automobile.

The base end portions of the guide-pin guiding portions 13 and 13 form the rectangular pipe 12. Therefore, the spring 16 and the slider 17 can be positioned with respect to the base body 11 merely by setting them 16 and 17 in the rectangular pipe 12.

One preferred embodiment of the invention has been described with reference to the accompanying drawings; however, it should be noted that the invention is not limited thereto or thereby. For instance, the slide grooves 13*a* and 13*a* may be modified into elongated holes. That is, it will be obvious to those skilled in the art that various changes and modifications may be made therein without departing from the invention.

As was described above, in the switch device of the invention, the slider has the guide pins at its outer end portion, and the guide pins are engaged with the slide grooves in the guide-pin guiding portions. Therefore, in the switch device, when compared with the conventional one, the amount of vibration of the operating knob is reduced, although the slider is adapted to hold the operating knob at the neutral position.

I claim:

1. A switch device comprising:

a base body;

an operating knob swingably provided over said base body, said operating knob having an articular recess including opposed sloped surfaces;

a slider having opposite inner and outer end portions slidably provided on said base body, the outer end portion of said slider being engaged with said articular recess to hold said operating knob at a neutral position, said slider being slidably actuating one of said sloped surfaces of said articular recess in accordance with swinging said operating knob;

a holding unit for holding said slider to slidably move said slider in a substantially vertical direction, said holding unit including guide pins protruded from the outer end portion of said slider, and guide pin guiding portions fixed to said base body for guiding said guide pins.

2. A switch device as claimed in claim 1, wherein said guide pin guiding portions include slide grooves.

3. A switch comprising:

a base body having a rectangular projection ending in two opposed walls, each of the walls having an elongated groove having a closed end and an open end;

a slider for slidable linear reciprocation in the projection, the slider having first and second guide pins engaging a respective elongated groove in the walls;

an operating knob being swingably connected to the base body, the operating knob including an articular recess with opposed sloped surfaces for engagement with the slider; and wherein when the operating knob is swung, one of the sloped surfaces engages the slider, and the slider is guided by the first and second guide pins to linearly slide within the projection.

4. The switch of claim 3 further comprising at least one operating piece slidably mounted in the base unit and at least one depressing portion projecting from the operating knob, wherein when the slider slides in a first direction, the depressing portion urges the operating piece to slide in the first direction.

5. A switch comprising:

a base body including a substantially rectangular portion, two opposed walls extending from the rectangular portion with each having an elongated groove having a closed end and an open end, and the rectangular portion having a spring mounted therein;

a slider having first and second opposite ends, the first end bearing against the spring to provide for slidable linear reciprocation of the slider in the rectangular portion, the second end having two guide pins each engaging a respective elongated groove in the walls;

an operating knob being swingably connected to the base body, the operating knob including an articular recess with opposed sloped surfaces for engagement with the slider; and wherein when the operating knob is swung, one of the sloped surfaces engages the slider, and the slider is guided by the guide pins to linearly slide within the rectangular portion against the spring.

* * * * *

UNITED STATES PATENT AND TRADEMARK OFFICE

CERTIFICATE OF CORRECTION

PATENT NO. : 5,357,071

DATED : October 18, 1994

INVENTOR(S) : Akira HANAKI

It is certified that error appears in the above-indentified patent and that said Letters Patent is hereby corrected as shown below:

Claim 1, column 4, line 36 change "slidably" to --slid by--.

Signed and Sealed this

Thirteenth Day of June, 1995

Bruce Lehman

*Attest:*

BRUCE LEHMAN

*Attesting Officer*

*Commissioner of Patents and Trademarks*